US006431650B1

(12) United States Patent
Visone

(10) Patent No.: US 6,431,650 B1
(45) Date of Patent: Aug. 13, 2002

(54) HEIGHT ADJUSTABLE WHEELCHAIR APPARATUS

(76) Inventor: Jeremy D. Visone, 586 Cypress Rd., Newington, CT (US) 06111

( * ) Notice: Subject to any disclaimer, the term of this patent is extended or adjusted under 35 U.S.C. 154(b) by 0 days.

(21) Appl. No.: 09/770,260

(22) Filed: Jan. 26, 2001

(51) Int. Cl.[7] ..... A47C 1/02

(52) U.S. Cl. ..... 297/339; 280/250.1; 297/DIG. 4; 297/411.36

(58) Field of Search ..... 297/339, 338, 297/344.12, DIG. 4, DIG. 10, 411.36, 440.24, 423.4, 311; 248/404; 280/250.1, 304.1

(56) References Cited

U.S. PATENT DOCUMENTS

| | | | | | |
|---|---|---|---|---|---|
| 2,913,732 | A | * | 11/1959 | Jones | 297/DIG. 4 X |
| 3,311,337 | A | * | 3/1967 | Vom Hagen | 297/338 |
| 3,382,000 | A | * | 5/1968 | Sully | 297/411.36 |
| 3,882,949 | A | | 5/1975 | Anderson | |
| 3,993,351 | A | * | 11/1976 | Rodaway | 297/411.36 |
| D269,172 | S | | 5/1983 | Minnebraker | |
| 4,489,981 | A | * | 12/1984 | Goletski | 297/411.36 |
| 4,598,944 | A | | 7/1986 | Meyer et al. | |
| 4,955,624 | A | | 9/1990 | Jeun-Long | |
| 5,112,076 | A | * | 5/1992 | Wilson | 297/DIG. 4 X |
| 5,211,414 | A | | 5/1993 | Galumbeck | |
| 5,242,138 | A | * | 9/1993 | Kornberg | 297/411.36 X |
| 5,513,867 | A | * | 5/1996 | Bloswick et al. | 297/339 X |
| 5,520,403 | A | | 5/1996 | Bergstrom et al. | |

OTHER PUBLICATIONS

Copy of a newspaper article from "The Hartford Courant" describing "IBOT". Dated Jan. 12, 2001. Hartford, CT.

* cited by examiner

*Primary Examiner*—Peter M. Cuomo
*Assistant Examiner*—Stephen Vu

(57) ABSTRACT

A height adjustable wheelchair apparatus for allowing users to be able to move more easily in and out of the wheelchair. The height adjustable wheelchair apparatus includes a frame, a wheel assembly upon which the frame is mounted, a seat member being mounted to the frame and being adapted to be raised and lowered, a backrest being mounted to the frame, an armrest assembly being removably mounted to the frame; and further includes a lift assembly being mounted to the frame and being adapted to raise and lower the seat member.

19 Claims, 3 Drawing Sheets

HEIGHT ADJUSTABLE WHEELCHAIR APPARATUS

BACKGROUND OF THE INVENTION

1. Field of the Invention

The present invention relates to a wheelchair and more particularly pertains to a new height adjustable wheelchair apparatus for allowing users to be able to move more easily in and out of the wheelchair.

2. Description of the Prior Art

The use of a wheelchair is known in the prior art. More specifically, a wheelchair heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,211,414; U.S Pat. No. 5,520,403; U.S. Pat. No. 4,598,944; U.S. Pat. No. 3,882,949; U.S. Pat. No. 4,955,624; and U.S. Pat. No. Des. 269,172.

While these devices fulfill their respective, particular objectives and requirements, the aforementioned patents do not disclose a new height adjustable wheelchair apparatus. The inventive device includes a frame and also includes a wheel assembly upon which the frame is mounted; and further includes a seat member being mounted to the frame and being adapted to be raised and lowered; and also includes a backrest being mounted to the frame; and further includes a footrest assembly being removably attached to the frame; and also includes an armrest assembly being removably mounted to the frame; and further includes a lift assembly being mounted to the frame and being adapted to raise and lower the seat member.

In these respects, the height adjustable wheelchair apparatus according to the present invention substantially departs from the conventional concepts and designs of the prior art, and in so doing provides an apparatus primarily developed for the purpose of allowing users to be able to move more easily in and out of the wheelchair.

SUMMARY OF THE INVENTION

In view of the foregoing disadvantages inherent in the known types of wheelchair now present in the prior art, the present invention provides a new height adjustable wheelchair apparatus construction wherein the same can be utilized for allowing users to be able to move more easily in and out of the wheelchair.

The general purpose of the present invention, which will be described subsequently in greater detail, is to provide a new height adjustable wheelchair apparatus which has many of the advantages of the wheelchair mentioned heretofore and many novel features that result in a new height adjustable wheelchair apparatus which is not anticipated, rendered obvious, suggested, or even implied b any of the prior art wheelchair, either alone or in any combination thereof.

To attain this, the present invention generally comprises a frame; and also includes a wheel assembly upon which the frame is mounted; and further includes a seat member being mounted to the frame and being adapted to be raised and lowered; and also includes a backrest being mounted to the frame; and further includes a footrest assembly being removably attached to the frame; and also includes an armrest assembly being removably mounted to the frame; and further includes a lift assembly being mounted to the frame and being adapted to raise and lower the seat member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new height adjustable wheelchair apparatus which has many of the advantages of the wheelchair mentioned heretofore and many novel features that result in a new height adjustable wheelchair apparatus which is not anticipated, rendered obvious, suggested, or even implied by any of the prior art wheelchair, either alone or in any combination thereof.

It is another object of the present invention to provide a new height adjustable wheelchair apparatus which may be easily and efficiently manufactured and marketed.

It is a further object of the present invention to provide a new height adjustable wheelchair apparatus which is of a durable and reliable construction.

An even further object of the present invention is to provide a new height adjustable wheelchair apparatus which is susceptible of a low cost of manufacture with regard to both materials and labor, and which accordingly is then susceptible of low prices of sale to the consuming public, thereby making such height adjustable wheelchair apparatus economically available to the buying public.

Still yet another object of the present invention is to provide a new height adjustable wheelchair apparatus which provides in the apparatuses and methods of the prior art some of the advantages thereof, while simultaneously overcoming some of the disadvantages normally associated therewith.

Still another object of the present invention is to provide a new height adjustable wheelchair apparatus for allowing users to be able to more easily in and out of the wheelchair.

Yet another object of the present invention is to provide a new height adjustable wheelchair apparatus which includes a frame; and also includes a wheel assembly upon which the frame is mounted; and further includes a seat member being mounted to the frame and being adapted to be raised and lowered; and also includes a backrest being mounted to the frame; and further includes a footrest assembly being removably attached to the frame; and also includes an armrest assembly being removably mounted to the frame; and further includes a lift assembly being mounted to the frame and being adapted to raise and lower the seat member.

Still yet another object of the present invention is to provide a new height adjustable wheelchair apparatus that would allow users to get in and out of the wheelchair independent of any help.

Even still another object of the present invention is to provide a new height adjustable wheelchair apparatus that reduces the amount of stress and strain placed on the user while getting in and out of the wheelchair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
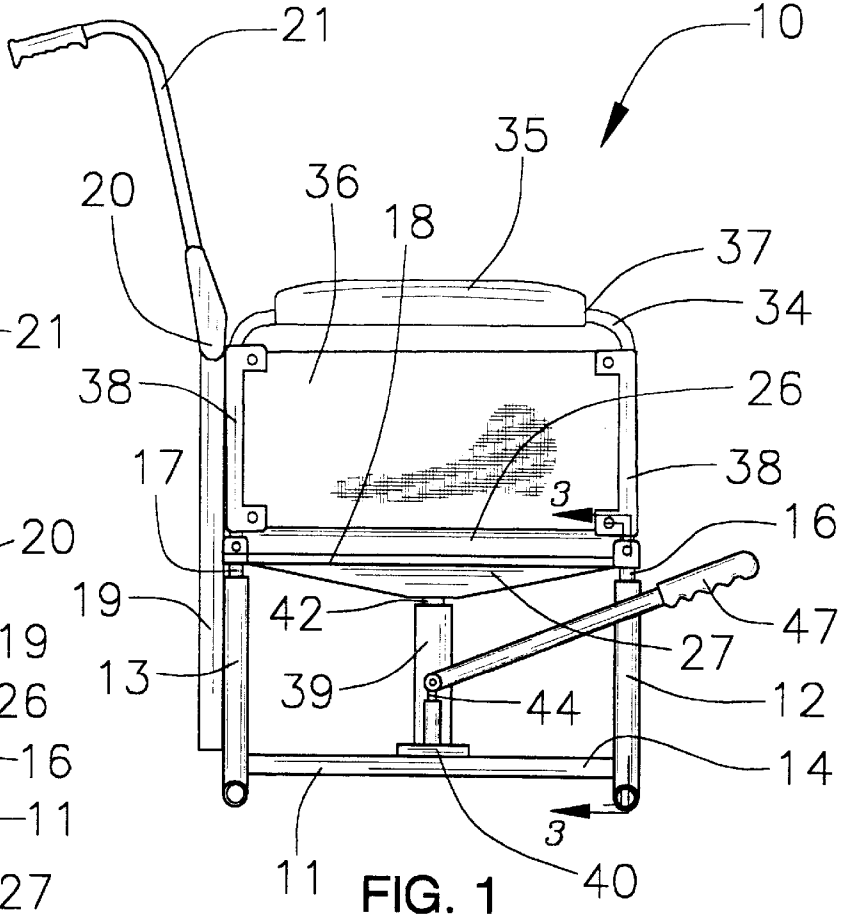
FIG. 1 is a side elevational view of a new height adjustable wheelchair apparatus according to the present invention.
Figure 2:
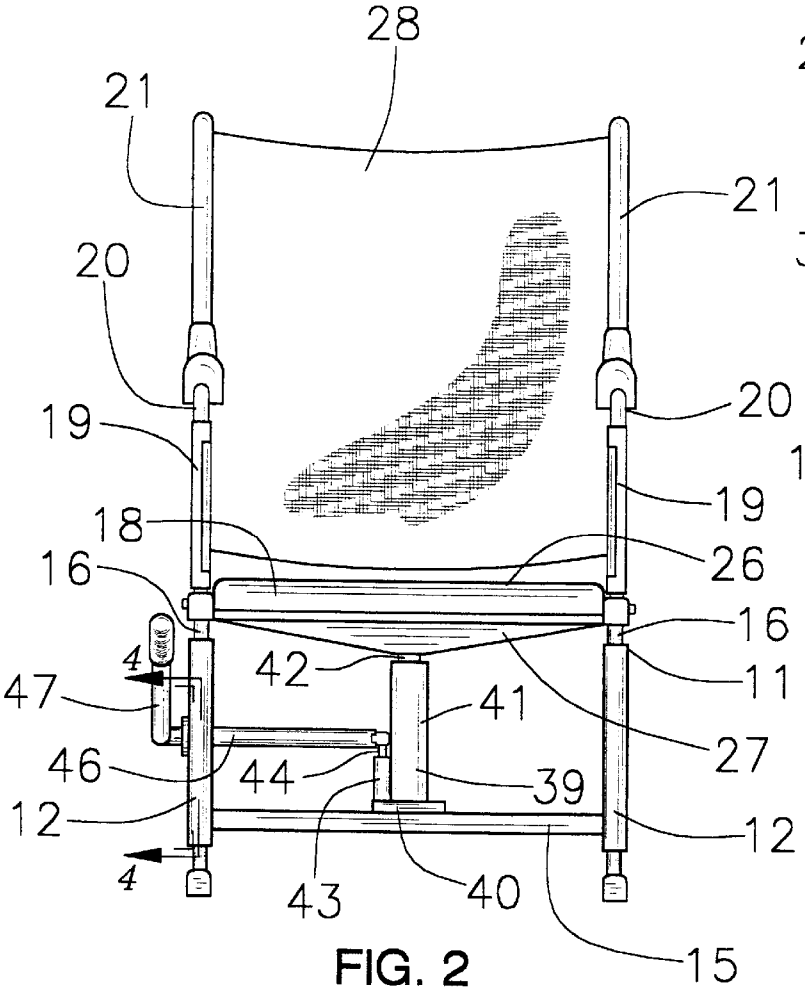
FIG. 2 is a front elevational view of the present invention.
Figure 3:
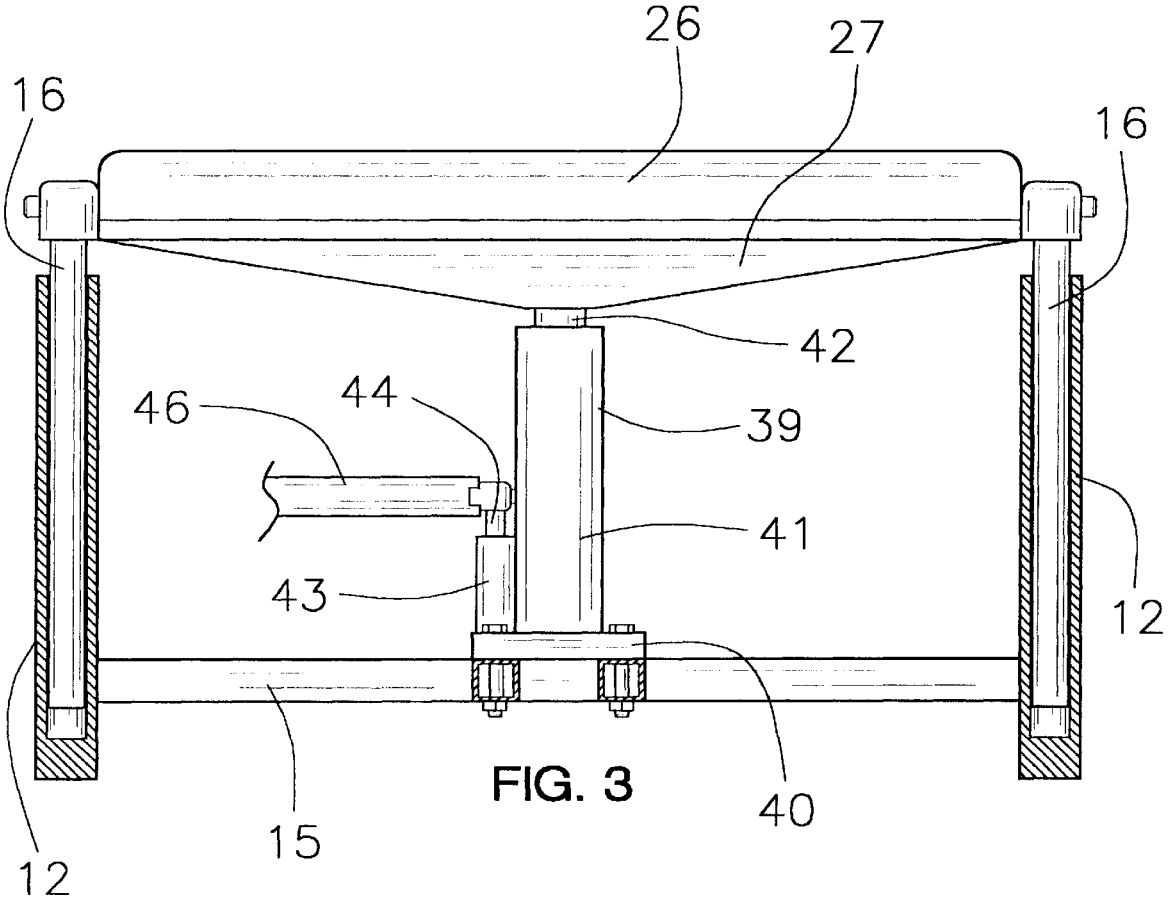
FIG. 3 is a detailed front elevational view of the lift assembly of the present invention.
Figure 4:
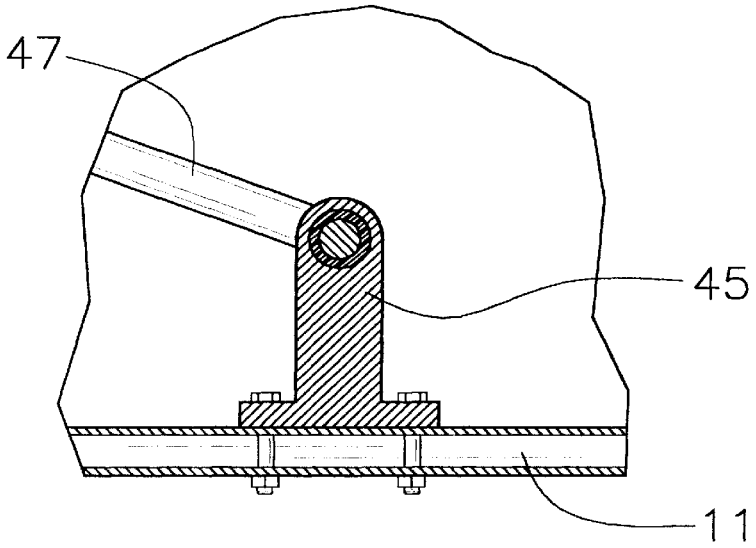
FIG. 4 is a detailed side elevational view of the pump of the present invention.
Figure 5:
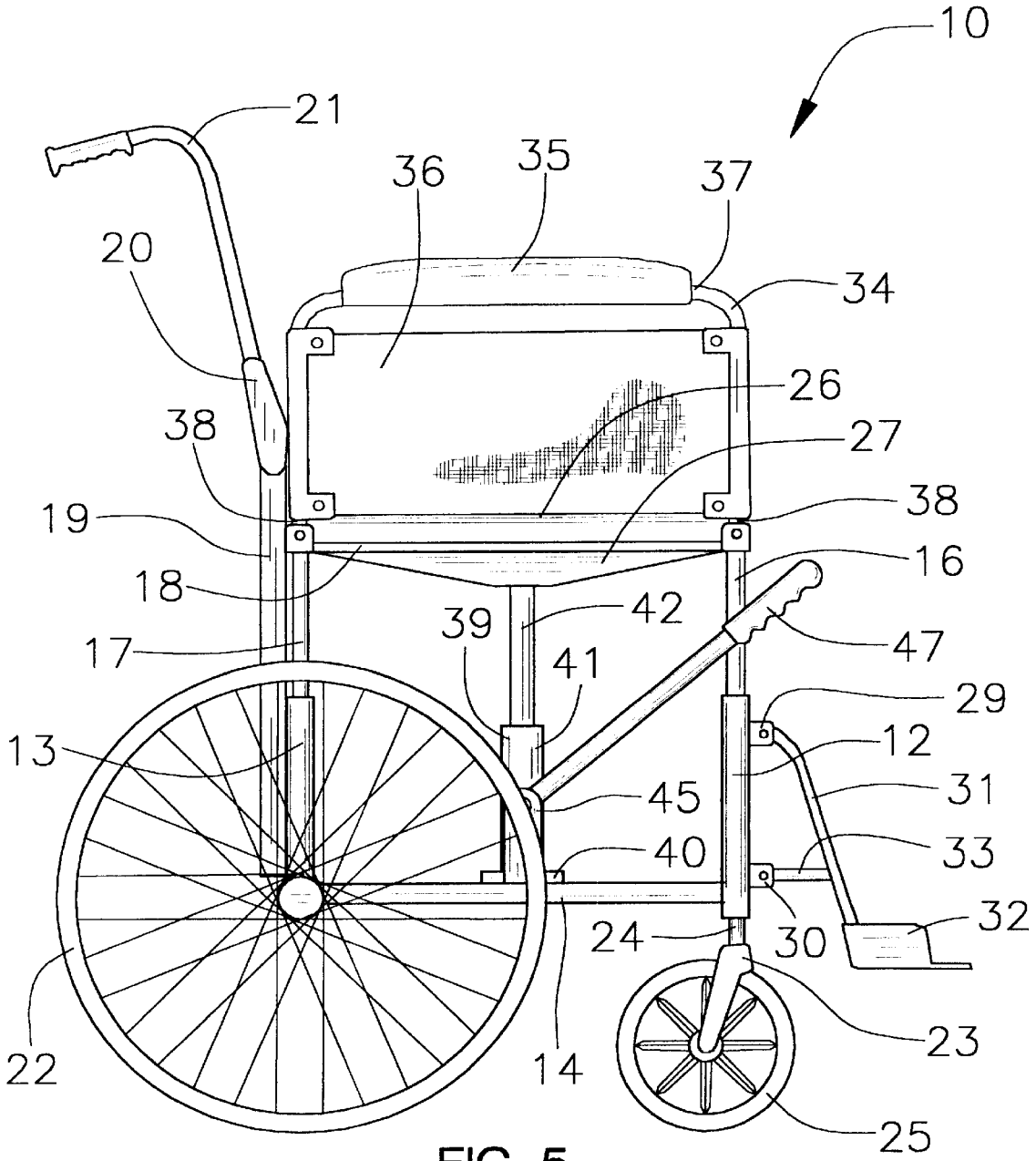
FIG. 5 is a side elevational view of the present invention.

With reference now to the drawings, and in particular to FIGS. 1 through 5 thereof a new height adjustable wheelchair apparatus embodying the principles and concepts of the present invention and generally designated by the reference numeral 10 will be described.

As best illustrated in FIGS. 1 through 5, the height adjustable wheelchair apparatus 10 generally comprises a frame 11 including a pair of lower elongate side members 14 and a lower elongate cross member 15 conventionally interconnecting the lower elongate side members 14, and also including a plurality of front and rear tubular members 12, 13 being securely and conventionally attached and vertically-disposed at ends of the lower elongate side members 14, and further including a plurality of elongate arm members 16,17 being movably disposed in and extendable from the front and rear tubular members 12,13, and also including a plurality of elongate seat support members 18 being securely and conventionally attached to and extending between and elongate arm members 16,17, and further including a plurality of elongate backrest support members 19 each having a main portion 20 and a handle portion 21 being angled relative to the main portion 20. The front and rear tubular members 12,13 have open top and bottom ends and also having bores extending therethrough.

The height-adjustable wheelchair apparatus 10 also comprises a wheel assembly upon which the frame 11 is conventionally mounted. The wheel assembly includes a pair of enlarged rear wheel members 22 being rotatably and conventionally mounted at the bottom ends of the rear tubular members 13 of the frame 11, and also includes front wheel members being removably mounted in the open bottom ends of the front tubular members 12. Each of the front wheel members includes a support bracket 23, a shaft 24 extending outwardly from the support bracket 23, and a caster-type wheel member 25 being rotatably mounted to the support bracket 23. The shaft 24 is removably received in the bore and through the open bottom end of a respective front tubular member 12.

A seat member is mounted to the frame 11 and is adapted to be raised and lowered. The seat member includes a platform 27 being securely and conventionally attached to the elongate seat support members 18, and also includes a seat cushion 26 being supported upon the platform 27. A backrest is conventionally mounted to the frame 11. The backrest includes a cushion member 28 being securely and conventionally attached to the elongate backrest support members 19.

A footrest assembly is removably attached to the frame 11. The footrest assembly includes first and second bracket members 29,30 being securely and conventionally attached to the front tubular members 12, and also includes elongate footrest support members 31 being securely and conventionally fastened to the first bracket members 29, and further includes footrest members 32 being securely and conventionally attached to ends of the elongate footrest support members 31, and also includes brace members 33 being securely and conventionally fastened to the second bracket members 30 and to the elongate footrest support members 31.

An armrest assembly is removably mounted to the frame 11 and includes a pair of armrest members 34 being removably mounted to the arm members 16,17 of the frame 11, and also includes pad members 35 being securely and conventionally attached to the armrest members 34, and further includes side panel members 36 being securely and conventionally attached to the armrest members 34. Each of the armrest members 34 includes an elongate main portion 37 and a pair of elongate end portions 38 which are angled relative to the elongate main portion 37 and which are removably mounted to the arm members 16,17. The pad members 35 are securely and conventionally mounted to the elongate main portions 37 of the armrest members 34, and the panel members 36 being securely and conventionally disposed between the elongate end portions 38.

A lift assembly is conventionally mounted to the frame 11 and is adapted to raise and lower the seat member 26,27. The lift assembly includes a hydraulic jack 39 being securely and conventionally mounted upon the elongate cross member 15 of the frame 11 and includes a base member 40 which is securely and conventionally mounted upon the elongate cross member 15, and also includes a cylindrical reservoir member 41 being conventionally mounted upon the base member 40, and further includes a first piston member 42 being movably disposed in and extendable from the cylindrical reservoir member 41 and having a top end which is securely and conventionally attached to a bottom of the platform 27, and also includes a cylindrical member 43 being conventionally mounted upon the base member 40, and further includes a second piston member 44 being movably disposed in and extendable from the cylindrical member 43, and also includes a crank assembly being conventionally attached to the second piston member 44 for moving the first piston member 42 in and out of the cylindrical reservoir member 41 to raise and lower the seat member 26,27. The crank assembly includes a crank support bracket 45 being securely and conventionally fastened upon one of the lower elongate side members 14, and also includes a linkage member 46 having a first end being securely and conventionally attached to the second piston member 44 and having a second end being journaled through the crank support bracket 45, and further includes a handle member 47 being securely and conventionally attached to the second end of the linkage member 46.

In use, the user pivots the handle member 47 up and down which causes the first piston member 42 to extend upwardly from the cylindrical reservoir member 41 and to raise the seat member 26,27. The user continues to pivot the handle member 47 according to how high the user wishes to raise the seat member 26,27. To lower the seat member 26,27, the user opens a valve member located in the base of the cylindrical reservoir member 41 to release the pressure within the cylindrical reservoir member 41 which allows the first piston member 42 to retract in the cylindrical reservoir member 41 thus lowering the seat member 26,27.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A height adjustable wheelchair apparatus comprising:

a frame;

a wheel assembly upon which said frame is mounted;

a seat member being mounted to said frame, said seat member having a generally planar upper surface which is oriented generally horizontally;

a backrest being mounted to said frame;

a footrest assembly being removably attached to said frame;

a footrest assembly being removably attached to said frame;

an armrest assembly being removably mounted to said frame; and a lift assembly being mounted to said frame and to said seat member, said lift assembly being extendable and retractable to raise and lower said seat member and said armrest assembly with respect to said frame and said backrest, said lift assembly raising and lowering said seat member with said upper surface maintained in a generally horizontal orientation.

2. The height adjustable wheelchair apparatus as described in claim 1, wherein said frame includes a pair of lower elongate side members and a lower elongate cross member interconnecting said lower elongate side members, and also including a plurality of front and rear tubular members being securely attached and vertically-disposed at ends of said lower elongate side members, and further including a plurality of elongate arm members being movably disposed in and extendable from said front and rear tubular members, and also including a plurality of elongate seat support members being securely attached to and extending between said elongate arm members, and further including a plurality of elongate backrest support members each having a main portion and a handle portion being angled relative to said main portion.

3. The height adjustable wheelchair apparatus as described in claim 2, wherein said seat member includes a platform being attached to said elongate seat support members, and also includes a seat cushion being supported upon said platform.

4. The height adjustable wheelchair apparatus as described in claim 3, wherein said lift assembly includes a hydraulic jack being mounted upon said elongate cross member of said frame and including a base member which is mounted upon said elongate cross member, and also including a cylindrical reservoir member being mounted upon said base member, and further including a first piston member being movably disposed in and extendable from said cylindrical reservoir member and having a top end which is attached to a bottom of said platform, and also including a cylindrical member being mounted upon said base member, and further including a second piston member being movably disposed in and extendable from said cylindrical member, and also including a crank assembly being attached to said second piston member for moving said first piston member in and out of said cylindrical reservoir member to raise and lower said seat member.

5. The height adjustable wheelchair apparatus as described in claim 4, wherein said crank assembly includes a crank support bracket being fastened upon one of said lower elongate side members, and also includes a linkage member having a first end being attached to said second piston member and having a second end being journaled through said crank support bracket, and further includes a handle member being attached to said second end of said linkage member.

6. The height adjustable wheelchair apparatus as described in claim 2, wherein said armrest assembly includes a pair of armrest members being removably mounted to said arm members of said frame, and also includes pad members being attached to said armrest members, and further includes side panel members being attached to said armrest members.

7. The height adjustable wheelchair apparatus as described in claim 6, wherein each of said armrest members includes an elongate main portion and a pair of elongate end portions which are angled relative to said elongate main portion and which are removably mounted to said arm members, said pad members being mounted to said elongate main portions of said armrest members, and said panel members being disposed between said elongate end portions.

8. A height adjustable wheelchair apparatus comprising:

a frame;

a wheel assembly upon which said frame is mounted;

a seat member being mounted to said frame and being adapted to be raised and lowered;

a backrest being mounted to said frame;

a footrest assembly being removably attached to said frame;

an armrest assembly being removably mounted to said frame; and a lift assembly being mounted to said frame and being adapted to raise and lower said seat member;

wherein said frame includes a pair of lower elongate side members and a lower elongate cross member interconnecting said lower elongate side members, and also including a plurality of front and rear tubular members being securely attached and vertically-disposed at ends of said lower elongate side members, and further including a plurality of elongate arm members being movably disposed in and extendable from said front and rear tubular members, and also including a plurality of elongate seat support members being securely attached to and extending between said elongate arm members, and further including a plurality of elongate backrest support members each having a main portions and a handle portion being angled relative to said main portion.

9. The height adjustable wheelchair apparatus as described in claim 8, wherein said front and rear tubular members have open top and bottom ends and also have bores extending therethrough.

10. The height adjustable wheelchair apparatus as described in claim 9, wherein said footrest assembly includes first and second bracket members being attached to said front tubular members, and also includes elongate footrest support members being securely fastened to said first bracket members, and furthers includes footrest members being attached to ends of said elongate footrest support members, and also includes brace members being fastened to said second bracket members and to said elongate footrest support members.

11. The height adjustable wheelchair apparatus as described in claim 9, wherein said wheel assembly includes a pair of enlarged rear wheel members being rotatably mounted at said bottom ends of said rear tubular members of said frame, and also includes front wheel members being removably mounted in said open bottom ends of said front tubular members.

12. The height adjustable wheelchair apparatus as described in claim 11, wherein each of said front wheel members includes a support bracket, a shaft extending outwardly from said support bracket, and a caster wheel member being rotatably mounted to said support bracket, said shaft being removably received in said bore and through said open bottom end of a respective said front tubular member.

13. The height adjustable wheelchair apparatus as described in claim 8, wherein said backrest includes a cushion member being attached to said elongate backrest support members.

14. The height adjustable wheelchair apparatus as described in claim 8, wherein said seat member includes a platform being attached to said elongate seat support members, and also includes a seat cushion being supported upon said platform.

15. The height adjustable wheelchair apparatus as described in claim 14, wherein said lift assembly includes a hydraulic jack being mounted upon said elongate cross member of said frame and including a base member which is mounted upon said elongate cross member, and also including a cylindrical reservoir member being mounted upon said base member, and further including a first piston member being movably disposed in and extendable from said cylindrical reservoir member and having a top end which is attached to a bottom of said platform, and also including a cylindrical member being mounted upon said base member, and further including a second piston member being movably disposed in and extendable from said cylindrical member, and also including a crank assembly being attached to said second piston member for moving said first piston member in and out of said cylindrical reservoir member to raise and lower said seat member.

16. The height adjustable wheelchair apparatus as described in claim 15, wherein said crank assembly includes a crank support bracket being fastened upon one of said lower elongate side members, and also includes a linkage member having a first end being attached to said second piston member and having a second end being journaled through said crank support bracket, and further includes a handle member being attached to said second end of said linkage member.

17. The height adjustable wheelchair apparatus as described in claim 8, wherein said armrest assembly includes a pair of armrest members being removably mounted to said arm members of said frame, and also includes pad members being attached to said armrest members, and further includes side panel members being attached to said armrest members.

18. The height adjustable wheelchair apparatus as described in claim 17, wherein each of said armrest members includes an elongate main portion and a pair of elongate end portions which are angled relative to said elongate main portion and which arm removably mounted to said arm members, said pad members being mounted to said elongate main portions of said armrest members, and said panel members being disposed between said elongate end portions.

19. A height adjustable wheelchair apparatus comprising:

a frame including a pair of lower elongate side members and a lower elongate cross member interconnecting said lower elongate side members, and also including a plurality of front and rear tubular members being securely attached and vertically-disposed at ends of said lower elongate side members, and further including a plurality of elongate arm members being movably disposed in and extendable from said front and rear tubular members, and also including a plurality of elongate seat support members being securely attached to and extending between said elongate arm members, and further including a plurality of elongate backrest support members each having a main portion and a handle portion being angled relative to said main portion, said front and rear tubular members having open top and bottom ends and also having bores extending therethrough;

a wheel assembly upon which said frame is mounted, said wheel assembly including a pair of enlarged rear wheel members being rotatably mounted at said bottom ends of said rear tubular members of said frame, and also including front wheel members being removably mounted in said open bottom ends of said front tubular members, each of said front wheel members including a support bracket, a shaft extending outwardly from said support bracket, and a caster wheel member being rotatably mounted to said support bracket, said shaft being removably received in said bore and through said open bottom end of a respective said front tubular member;

a seat member being mounted to said frame and being adapted to be raised and lowered said seat member including a platform being securely attached to said elongate seat support members, and also including a seat cushion being supported upon said platform;

a backrest being mounted to said frame, said backrest including a cushion member being securely attached to said elongate backrest support members;

a footrest assembly being removably attached to said frame, said footrest assembly including first and second bracket members being securely attached to said front tubular members, and also including elongate footrest support members being securely fastened to said first bracket members, and further including footrest members being securely attached to ends of said elongate footrest support members, and also including brace members being securely fastened to said second bracket members and to said elongate footrest support members;

an armrest assembly being removable mounted to said frame, said armrest assembly including a pair of armrest members being removably mounted to said arm members of said frame, and also including pad members being securely attached to said armrest members, and further including side panel members being securely attached to said armrest members, each of said armrest members including an elongate main portion and a pair of elongate end portions which are angled relative to said elongate main portion and which are removably mounted to said arm members, and pad members being securely mounted to said elongate main portions of said armrest members, and said panel members being securely disposed between said elongate end portions; and a lift assembly being mounted to said frame and being adapted to raise and lower said seat member, said lift assembly including a hydraulic jack being securely mounted upon said elongate cross member of said frame and including a base member which is securely mounted upon said elongate cross member, and also including a cylindrical reservoir member being mounted upon said base member, and further including a first piston member being movably disposed in and extendable from said cylindrical reservoir member and having a top end which is securely attached to a bottom of said platform, and also including a cylindrical member being mounted upon said base member, and further including a second piston member being movably disposed in and extendable from said cylindrical member, and also including a crank assembly being attached to said second piston member for moving said first piston member in and out of said cylindrical reservoir member to raise and lower said seat member, said crank assembly including a crank support bracket being securely fastened upon one of said lower elongate side members, and also including a linkage member having a first end being securely attached to said second piston member and having a second end being journaled through said crank support bracket, and further including a handle member being securely attached to said second end of said linkage member.

* * * * *